US009976753B2

(12) United States Patent
Hynes

(10) Patent No.: US 9,976,753 B2
(45) Date of Patent: May 22, 2018

(54) DECORATIVE APPLIANCE DOOR

(71) Applicant: VINOTEMP INTERNATIONAL CORPORATION, Rancho Dominguez, CA (US)

(72) Inventor: India Hynes, Newport Beach, CA (US)

(73) Assignee: VINOTEMP INTERNATIONAL CORPORATION, Irvine, CA (US)

( * ) Notice: Subject to any disclaimer, the term of this patent is extended or adjusted under 35 U.S.C. 154(b) by 470 days.

(21) Appl. No.: 14/507,076

(22) Filed: Oct. 6, 2014

(65) Prior Publication Data

US 2015/0101587 A1 Apr. 16, 2015

Related U.S. Application Data

(60) Provisional application No. 61/890,786, filed on Oct. 14, 2013.

(51) Int. Cl.

| | |
|---|---|
| ***F24C 15/04*** | (2006.01) |
| ***A47F 3/04*** | (2006.01) |
| *F25D 23/02* | (2006.01) |

(52) U.S. Cl.

CPC ..... *F24C 15/04* (2013.01); *A47F 3/0434* (2013.01); *F25D 23/02* (2013.01); *F25D 2400/18* (2013.01)

(58) Field of Classification Search

CPC ..... A47F 3/0434; F24C 15/04; F25D 23/02; F25D 2400/18

See application file for complete search history.

(56) References Cited

U.S. PATENT DOCUMENTS

| | | | | |
|---|---|---|---|---|
| 3,088,453 | A * | 5/1963 | Grahn | F24C 15/04 126/200 |
| D576,822 | S | 9/2008 | Hynes | |
| D586,585 | S | 2/2009 | Hynes | |
| D711,936 | S | 8/2014 | Hynes | |
| 2006/0154085 | A1* | 7/2006 | Cleary | B32B 17/10036 428/426 |
| 2013/0192108 | A1* | 8/2013 | Madhavan | G09F 23/00 40/594 |

FOREIGN PATENT DOCUMENTS

| | | |
|---|---|---|
| CN | 2559756 | 7/2003 |
| CN | 2736504 | 10/2005 |
| CN | 102136515 | 7/2011 |
| CN | 203879223 | 10/2014 |

OTHER PUBLICATIONS

First Office Action of State Intellectual Property Office of China and Search Report, Application No. 2014101006645, dated Apr. 12, 2017, in 13 pages.

* cited by examiner

*Primary Examiner* — Alfred Basichas
(74) *Attorney, Agent, or Firm* — Knobbe, Martens, Olson & Bear, LLP

(57) ABSTRACT

A transparent glass appliance door is provided with a reflective coating in the shape of a frame, resembling the conventional metal frame which usually surrounds and supports the glass. The reflective frame leaves a clear area through which the interior of the appliance can be viewed.

13 Claims, 7 Drawing Sheets

PRIOR ART

DECORATIVE APPLIANCE DOOR

BACKGROUND OF THE INVENTION

1. Field of the Invention

The present invention relates to appliances utilizing glass paneled doors such as beverage refrigerators, wine coolers, ovens and, more particularly, to a decorative door for such appliances.

2. General Background and State of the Art

In recent years, it has become popular to equip appliances such as beverage refrigerators, wine coolers, ovens and others with doors that incorporated a glass panel through which the interior and its contents could be viewed. Conventionally, a metal frame could be employed in which a glass pane could be installed. The frame could be polished and reflective or could be non reflective with a brushed textured surface.

Some appliances have employed a glass door, eliminating the metal frame. In such embodiments, the glass was thick enough to be structurally sound and also sufficiently insulative as to maintain the temperature differentials between the interior and exterior of the appliance. However, the aesthetics of a reflective frame are lost when the glass door is used without the metal frame.

INVENTION SUMMARY

According to the present invention, a glass door is provided with a mirror coating which occupies the areas that would normally be covered by a reflective metal frame. In one embodiment, the mirroring can be on an external surface of an inner pane and a clear glass pane serves as outer pane to protect the inner pane and, incidentally, add to the insulative qualities of the resultant glass door.

In alternative embodiments, the mirror coating can be applied to an inner surface of a glass pane so that it is protected from exterior elements and is not affected when the exterior of the pane is cleaned or subjected to potentially harmful encounters. In this embodiment, a second pane can be adjacent the mirrored surface to further protect the mirroring.

The mirroring can be applied in several ways. It can be a foil or polyester film that is adhered to the glass. It can be vapor deposited on the glass surface. It also can be applied as a coating to the glass through techniques such as magnetron sputtering. The mirroring is applied to the surface adjacent the edges so that a frame effect is achieved. Yet another technique is the application of a reflective coating using silk screen printing; Where displays are provided that are to be viewed through the door, the mirroring can be absent over the displays.

While less desirable, the mirror surfacing can be applied to an exterior surface. This would subject the mirror to potential environmental hazards as well as the potentially destructive hazards of cleaning or polishing the door.

In preferred embodiments, double panes are utilized to enhance the insulative qualities of the resulting structure. Which surface provides the reflective effect can be a matter of aesthetics and design choice. Moreover, it is elementary that a pane with a mirror coating applied to a surface can be an inner pane with a clear outer pane cover or an outer pane with the coating on the inner surface.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE PREFERRED EMBODIMENTS

Figure 1:
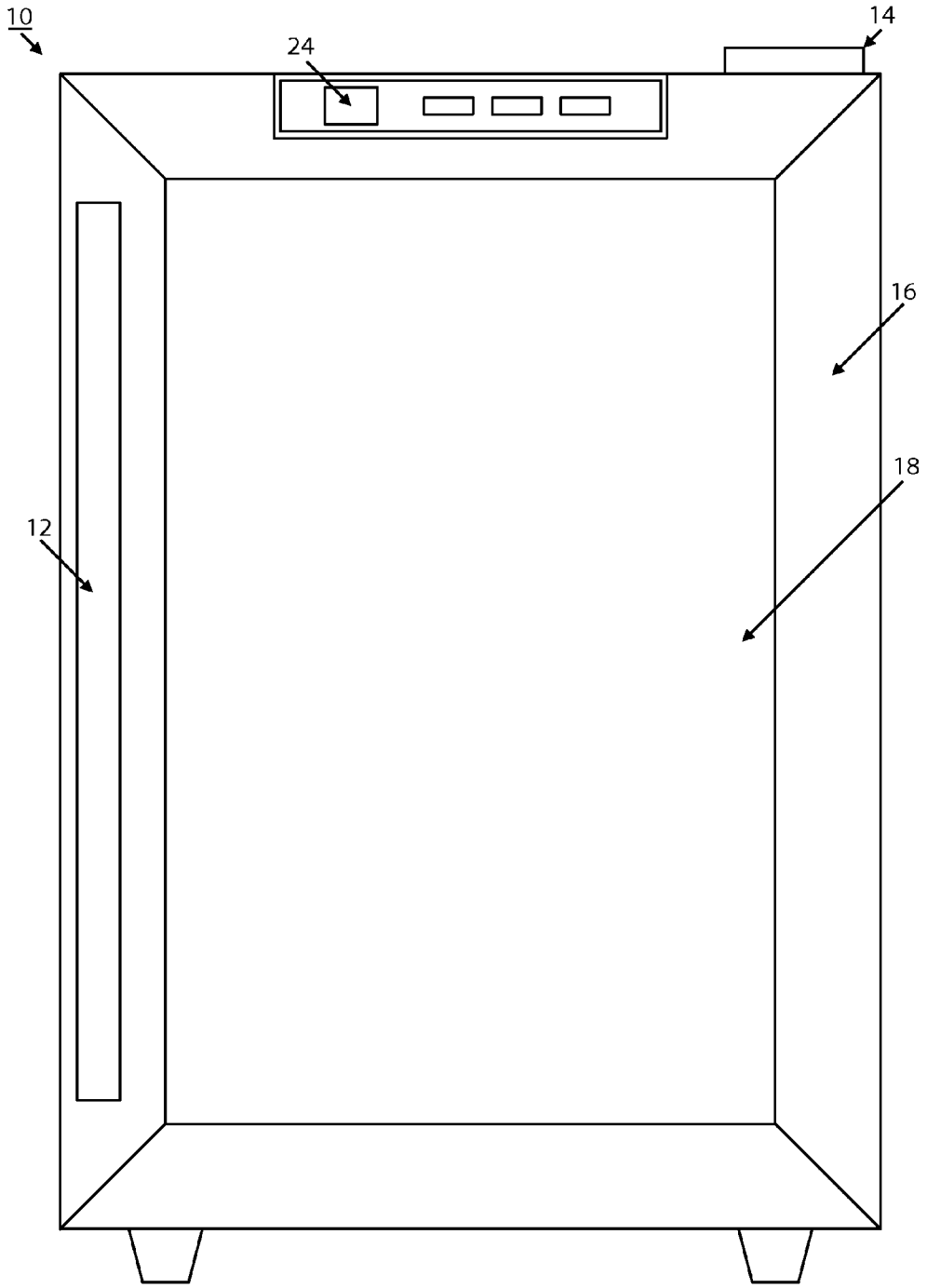
FIG. 1 is a front view of a prior art appliance door.

Turning first to FIG. 1, there is shown a prior art appliance door 10, in this case a door for a wine cooler cabinet. The door 10 includes a handle 12 and hinges 14 which permit the door 10 to open and close. As shown, the door 10 is bordered by a reflective metallic frame 16 in which a glass pane 18 is mounted.

Through the glass pane 18, the contents of the cabinet can be seen, here a plurality of wine bottles 20 resting on shelves 22. A control panel 24 is located in the upper portion of the frame 16. In the embodiment shown, the control panel 24 is used to set temperature and other parameters of the interior environment to maintain the wine at acceptable levels of temperature and humidity for optimum wine storage and preservation.

Similar doors can be provided to other appliances in which it is desirable to view the interior of the appliance. This could include wine refrigerators, ovens and others. The prior art metal frame can have a mirror finish to satisfy aesthetic desires.

Figure 2:
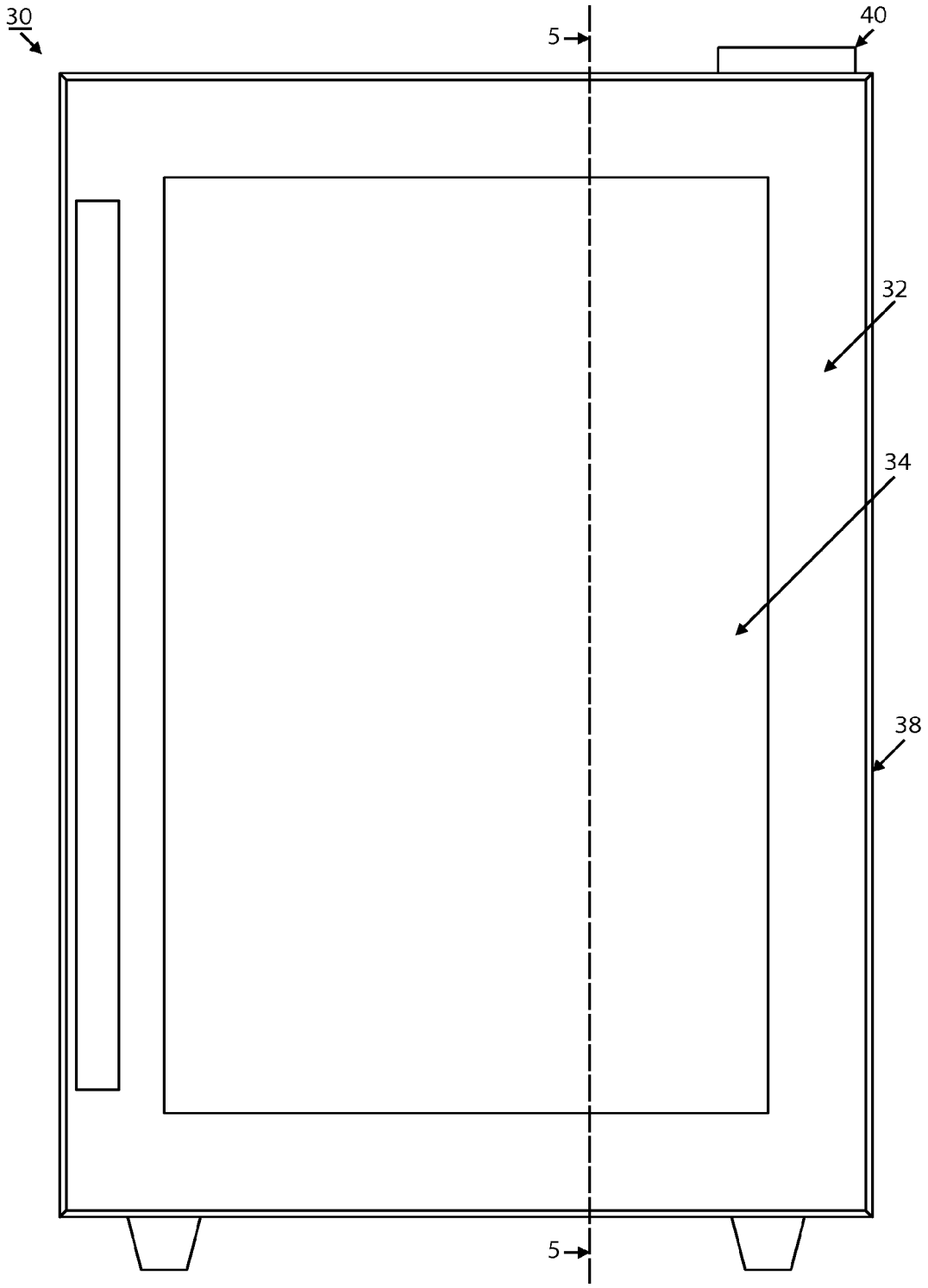
FIG. 2 is a front view of an appliance door according to the present invention.
Figure 3:
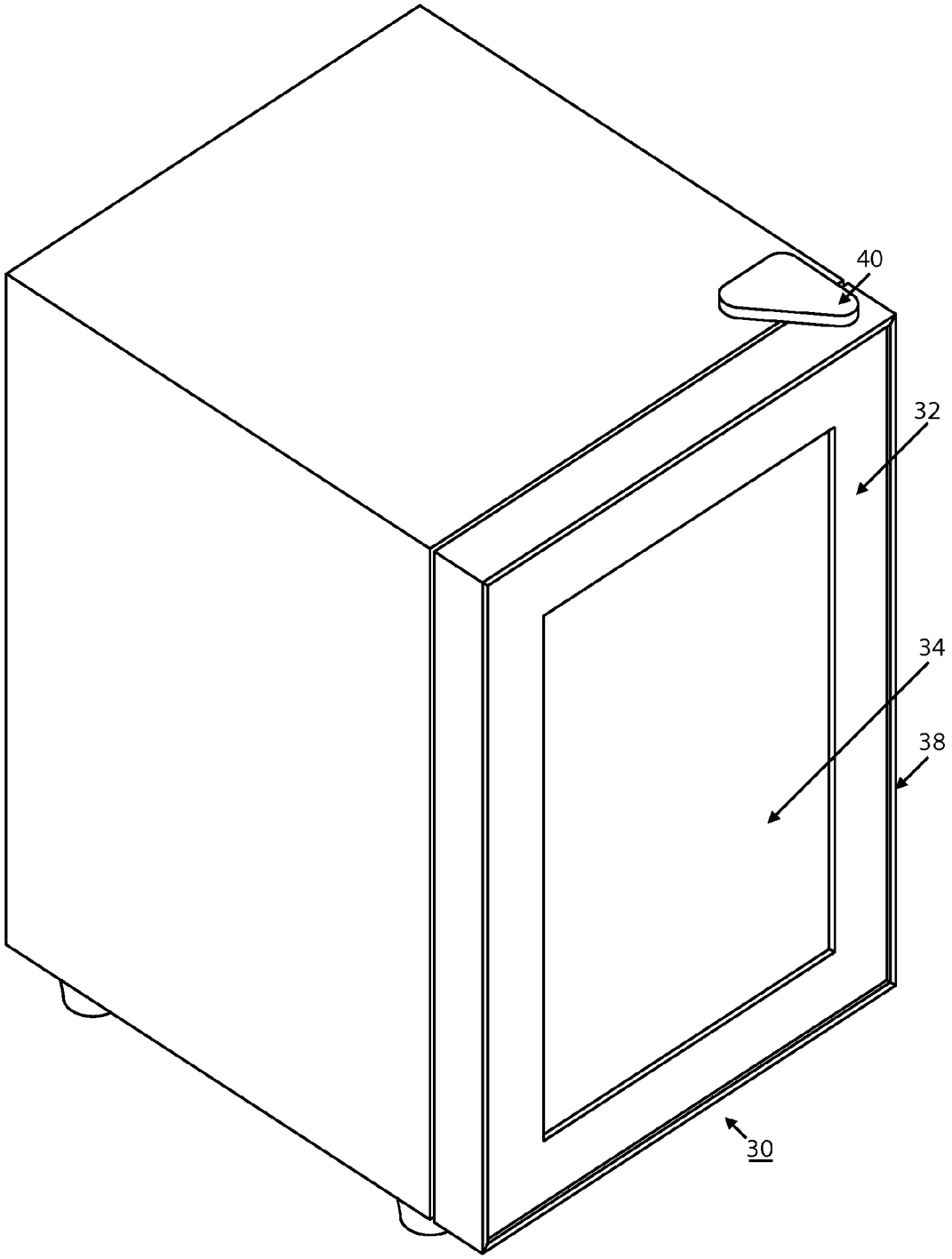
FIG. 3 is a perspective view of an appliance door according to the present invention.

Turning next to FIGS. 2 and 3, there is shown an appliance door 30 according to the present invention. The door 30 has a mirrored portion 32 which resembles or mimics the metal frame 16 of the prior art door 10. As seen, the door is comprised of a pair of glass panes or panels 34, 36, best seen in FIG. 5. The mirrored portion 32 can be applied to a back surface of an exterior pane 34 or the front surface of an interior pane.

It is also possible to apply the mirrored surface to the back surface of an interior pane or the front surface of an exterior pane. The placement of the mirrored surface is dependant upon the thickness and clarity of the glass panes and is chosen with the goal of most closely resembling a prior art door in appearance. The panels 34, 36 are held together with u-shaped band 38 that surrounds them. A hinge 40 permits the door 30 to open and close.

Figure 4:
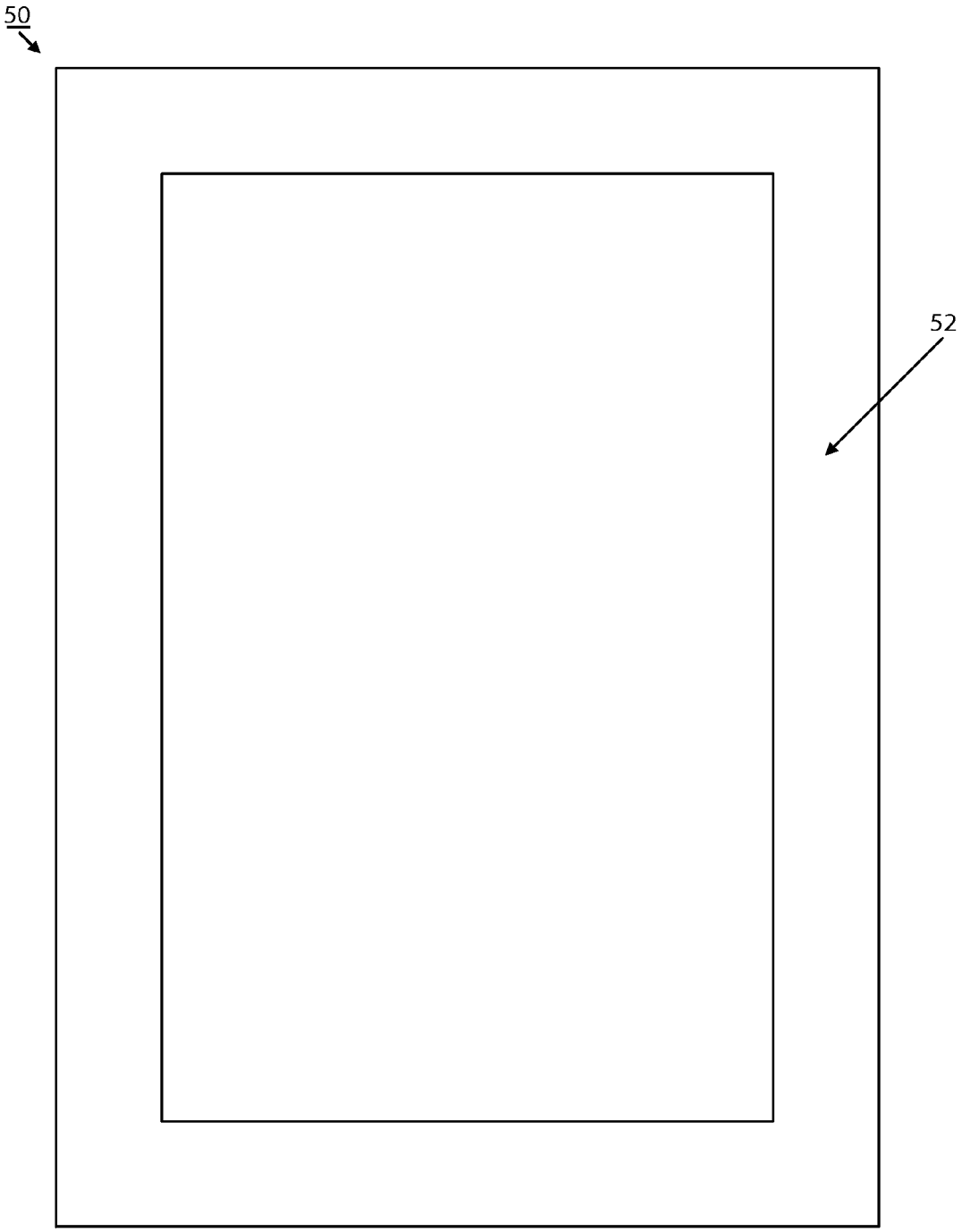
FIG. 4 is a front view of a glass pane according to the present invention.

FIG. 4 is a single pane 50 to which a mirroring surface 52 is applied. The mirroring can be achieved by a polyester foil, vapor deposition, sputtering, silk screening, or any other available means. The mirroring surface 52 is applied to the periphery of the pane and extends to create a "frame", leaving the central part of the pane transparent so that the interior of the appliance is visible through the pane.50.

The pane 50 can be an interior pane or an exterior pane. The mirroring 52 can be on an interior or exterior surface of the interior pane or the exterior pane. In some applications, it is preferable that the mirroring be on the interior surface of an exterior pane with the reflective surface adjacent the pane so that it is visible through the pane at the exterior surface.

Other applications could have the mirroring 52 on the exterior surface of an interior pane to be viewed through the exterior pane. Less desirable would be placement of the mirroring on the interior surface of the interior pane or on the exterior surface of an exterior pane. For the former, the thickness of the glass could attenuate the reflectivity while the latter places the mirroring in greater danger of damage.

Figure 5:
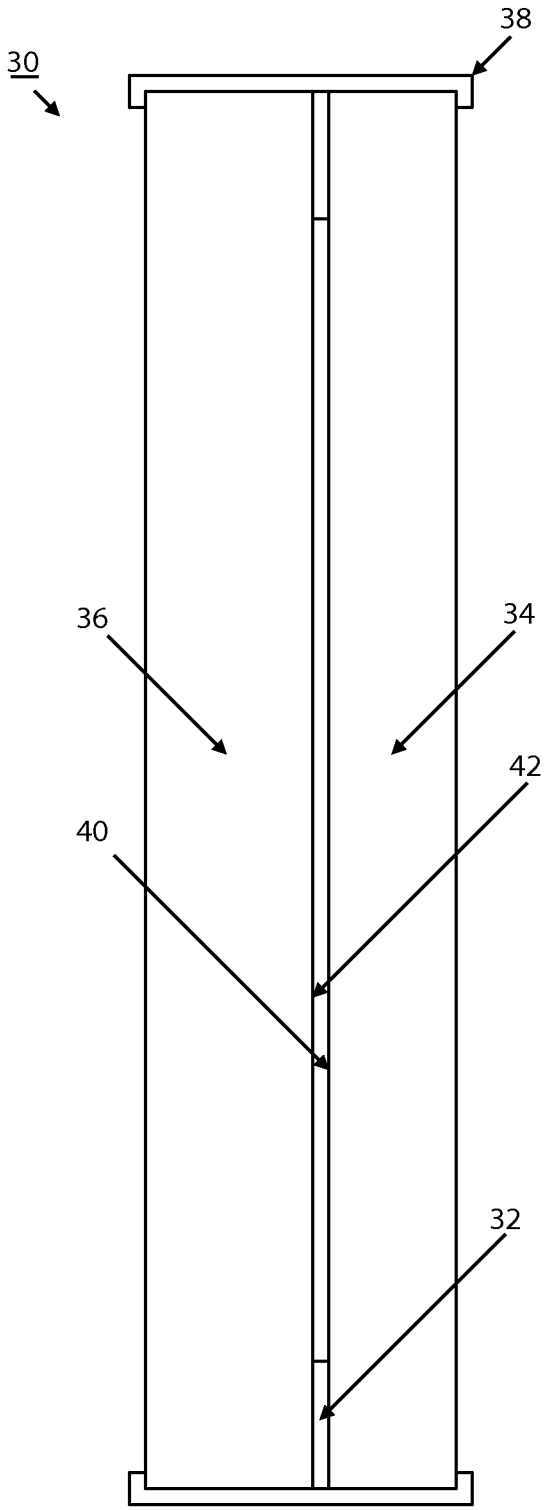
FIG. 5 is a side section view of the double pane door of FIG. 2, taken along line 5-5 in the direction of the appended arrows.

Turning next to FIG. 5, a side sectional view of the door 30 of FIG. 2 is shown. As seen, the mirroring 32 can either be applied to the front surface 40 of the interior panel 36 or the rear surface 42 of the exterior panel 34. It will be understood that the panes have been exaggerated to allow a better understanding of the covered structure.

Figure 6:
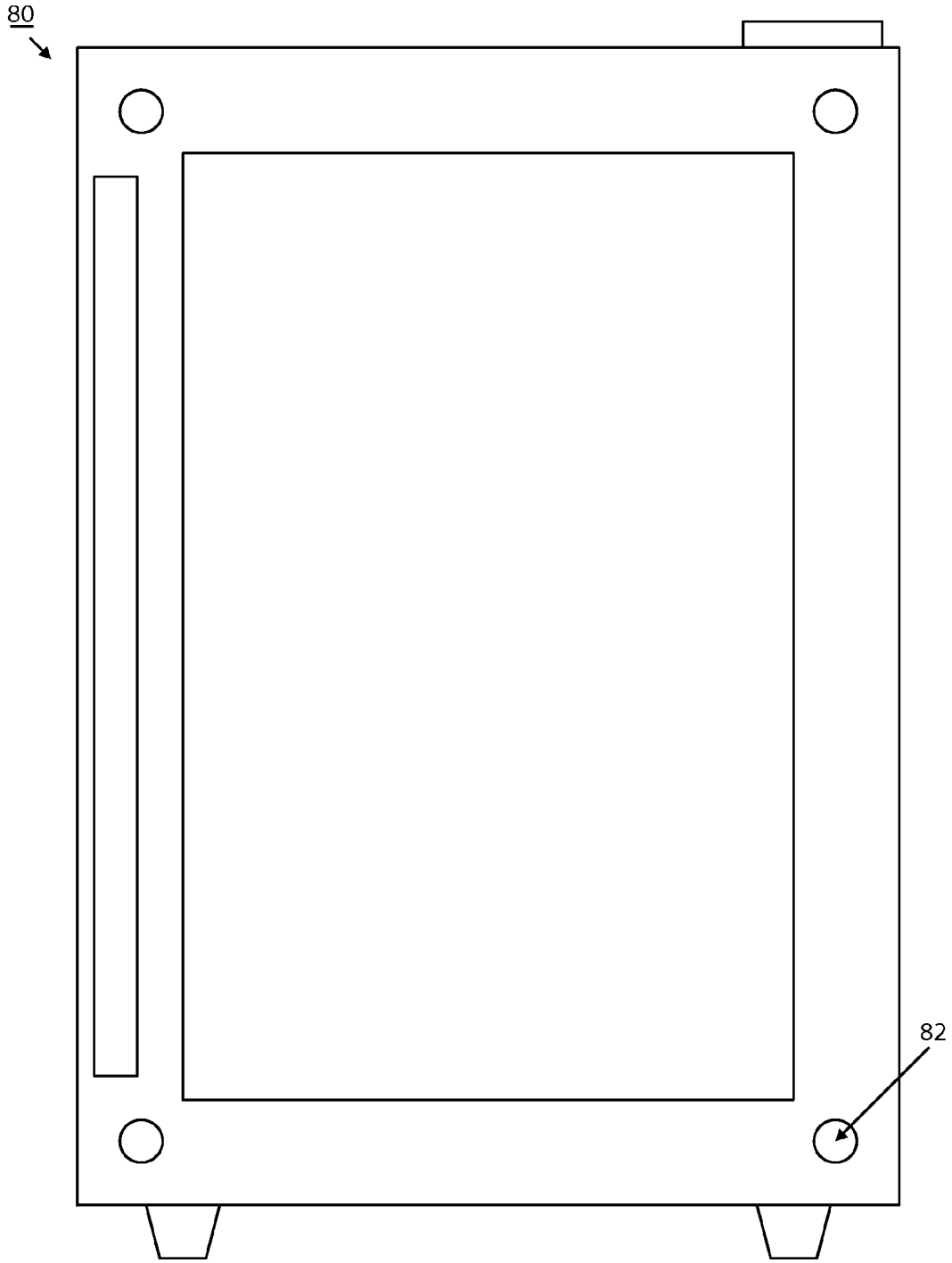
FIG. 6 is a front view of an appliance door according to an alternative embodiment of the present invention.

In FIG. 6, there is shown an alternative embodiment of the appliance door of the present invention. Door 80 is substantially similar to door 30 of FIG. 2 with the main difference being that the u shaped channel/band 38 of FIG. 2 is replaced here by fasteners 82 which hold the panes 84 and 86 (not shown) together. In all other respects, the door 30 and the door 80 are the same.

Figure 7:
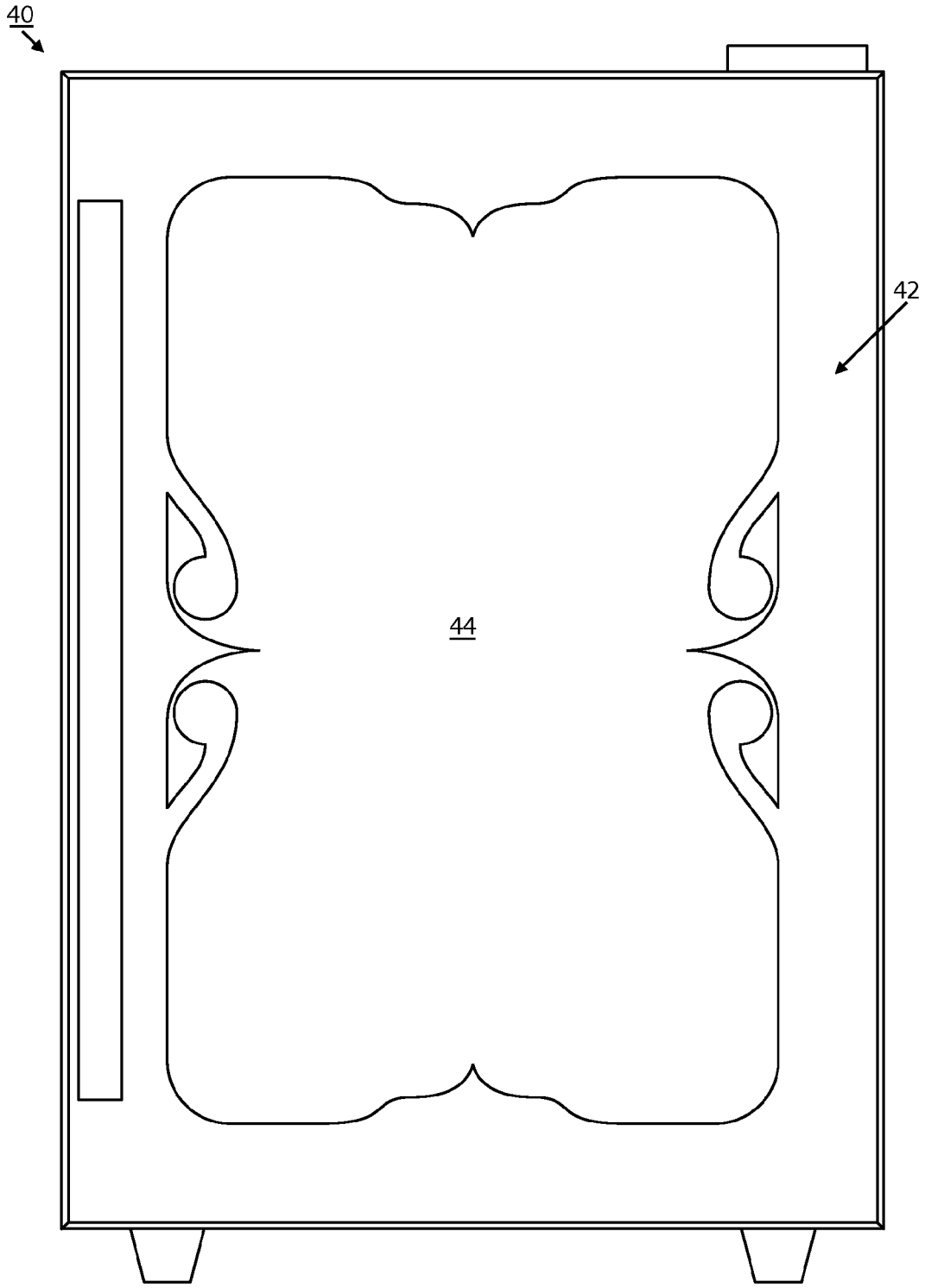
FIG. 7 is a front view of an appliance door according to another alternative embodiment.

FIG. 7 shows an appliance door 40 with an alternative pattern of mirroring 42. Rather than the rectangular frame shaped mirror of the other alternatives, this embodiment permits the mirror frame 42 to have a more decorative pattern. Moreover, an artistic aesthetic can be employed to provide even more fanciful designs to surround the clear opening 44 which enables visualization of the contents of the interior of the appliance for which the door 40 is intended.

While the specification describes particular embodiments of the present invention, those of ordinary skill can devise variations of the present invention without departing from the inventive concept.

The invention claimed is:

1. An appliance, comprising:

a body portion defining an interior; and a door coupled to the body portion by a hinge, which allows the door to be opened and closed relative to the body portion, wherein the door comprises:

a transparent exterior panel;

a transparent interior panel; and a mirroring frame located between the exterior panel and the interior panel and affixed to at least one of an interior surface of the exterior panel and an exterior surface of the interior panel, the mirroring frame configured to create a reflective surface visible at the exterior surface of the door, wherein the mirroring frame is located at a periphery of the exterior panel and the interior panel, wherein the mirroring frame defines a completely enclosed loop around the periphery of the exterior panel and the interior panel such that an interior portion of the exterior panel and the interior panel within the enclosed loop of the mirroring frame remains transparent.

2. The appliance of claim 1, further comprising a U-shaped band that extends around an outer edge of the door and couples the exterior panel and the interior panel to one another.

3. The appliance of claim 1, wherein the exterior panel and the interior panel are separated only by a thickness of the mirroring frame.

4. The appliance of claim 1, wherein the door further comprises at least one handle.

5. The appliance of claim 1, wherein the door further comprises at least one control panel.

6. The appliance of claim 1, wherein the exterior panel is mounted to the interior panel by connecting means.

7. The appliance of claim 1, wherein there is vacuum between the exterior panel and the interior panel.

8. The appliance of claim 1, wherein the mirroring frame comprises a reflective material.

9. The appliance of claim 8, wherein the reflective material is a reflective foil.

10. The appliance of claim 8, wherein the reflective material is a deposited vapor.

11. The appliance of claim 8, wherein the reflective material is the result of a sputtering technique.

12. The appliance of claim 8, wherein the reflective material is a reflective film.

13. The appliance of claim 8, wherein the reflective material is applied by adhesive.

* * * * *